US007266976B2

(12) United States Patent
Eaton et al.

(10) Patent No.: US 7,266,976 B2
(45) Date of Patent: Sep. 11, 2007

(54) VERTICAL HEAT EXCHANGER CONFIGURATION FOR LNG FACILITY

(75) Inventors: Anthony P. Eaton, Sugar Land, TX (US); Bobby D. Martinez, Missouri City, TX (US); Michael Christian, Panorama Village, TX (US)

(73) Assignee: ConocoPhillips Company, Bartlesville, OK (US)

( * ) Notice: Subject to any disclaimer, the term of this patent is extended or adjusted under 35 U.S.C. 154(b) by 256 days.

(21) Appl. No.: 10/972,821

(22) Filed: Oct. 25, 2004

(65) Prior Publication Data

US 2006/0086140 A1 Apr. 27, 2006

(51) Int. Cl.
*F25J 1/00* (2006.01)
*F28D 7/10* (2006.01)

(52) U.S. Cl. ..... 62/612; 165/157

(58) Field of Classification Search ..... 62/611, 62/612, 613; 165/157, 162
See application file for complete search history.

(56) References Cited

U.S. PATENT DOCUMENTS 2,182,183 A * 12/1939 Thompson ..... 165/109.1
3,289,757 A * 12/1966 Rutledge ..... 165/166
3,407,052 A * 10/1968 Huntress et al. ..... 48/127.3
3,590,909 A * 7/1971 Butt ..... 165/108
3,666,423 A * 5/1972 Muenger ..... 422/200
4,222,756 A * 9/1980 Thorogood ..... 62/647
5,071,458 A * 12/1991 Grenier et al. ..... 165/166
5,205,351 A * 4/1993 Muller et al. ..... 165/110
5,385,203 A * 1/1995 Mitsuhashi et al. ..... 165/110
5,613,373 A 3/1997 Grenier
5,813,250 A 9/1998 Ueno et al.
5,979,182 A * 11/1999 Goto et al. ..... 62/643
6,105,389 A 8/2000 Paradowski et al.
6,289,692 B1 * 9/2001 Houser et al. ..... 62/613
6,349,566 B1 * 2/2002 Howard et al. ..... 62/627
6,622,784 B2 * 9/2003 Davidian ..... 165/166

* cited by examiner

*Primary Examiner*—William C Doerrler
(74) *Attorney, Agent, or Firm*—Hovey Williams LLP

(57) ABSTRACT

LNG facility employing one or more vertical core-in-kettle heat exchangers to cool natural gas via indirect heat exchange with a refrigerant. The vertical core-in-kettle heat exchangers save plot space and can be use to reduce the size of cold boxes employed in the LNG facility. In addition, vertical core-in-kettle heat exchangers can exhibit enhanced heat transfer efficiency due to improved refrigerant access to the core, improved refrigerant circulation around the core, and/or improved vapor/liquid disengagement above the core.

77 Claims, 8 Drawing Sheets

VERTICAL HEAT EXCHANGER CONFIGURATION FOR LNG FACILITY

BACKGROUND OF THE INVENTION

1. Field of the Invention

This invention relates to a method and apparatus for liquefying natural gas. In another aspect, the invention concerns an improved method and apparatus for facilitating indirect heat transfer between a refrigerant and a cooled fluid. In still another aspect, the invention relates to a system for liquefying natural gas that employs at least one vertical core-in-kettle heat exchanger to cool the natural gas.

2. Description of the Prior Art

The cryogenic liquefaction of natural gas is routinely practiced as a means of converting natural gas into a more convenient form for transportation and storage. Such liquefaction reduces the volume of the natural gas by about 600-fold and results in a product which can be stored and transported at near atmospheric pressure.

Natural gas is frequently transported by pipeline from the supply source to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when demand exceeds supply. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state; the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems). A liquefaction methodology which is particularly applicable to the current invention employs an open methane cycle for the final refrigeration cycle wherein a pressurized LNG-bearing stream is flashed and the flash vapors (i.e., the flash gas stream(s)) are subsequently employed as cooling agents, recompressed, cooled, combined with the processed natural gas feed stream and liquefied thereby producing the pressurized LNG-bearing stream.

Many LNG facilities are located in relatively remote areas near natural gas reserves. When a new LNG facility is built in such a remote location it is common for the major components of the LNG facility to be manufactured in a more populated area and subsequently shipped (usually by ocean-going vessel) to the site of the LNG facility for final assembly. In order to save costs, it is desirable for the bulk of the complex components of the LNG facility to be constructed prior to shipping, so that most of the construction at the site of the LNG facility involves relatively simple assembly of the pre-fabricated complex components. However, as the capacity and size of LNG facilities increases, certain complex components have become too large to construct off-site and then ship to the final destination. One such component is known as a "cold box."

A cold box is simply an enclosure that houses a plurality of refrigeration components (e.g., heat exchangers, valves, and conduits) that operate at a similar low temperature. In a typical cold box, the refrigeration components are assembled in the enclosure and surrounded by a flowable insulation (e.g., particles of expanded perlite) to insulated the multiple refrigeration components. Cold boxes provide a much more efficient and cost effective means for insulating multiple refrigeration components, verses individually insulating each component.

As alluded to above, it is much less expensive to assemble all of the components of a cold box in a more populated area and then ship the entire assembled cold box to the remote LNG facility site for installation. However, as LNG facilities have continued to increase in capacity and size, the size of cold boxes has also increased. In fact, some cold boxes are now too large to ship on standard ocean-going vessels. The main reason for the increased size of the cold boxes is that the conventional horizontal core-in-kettle heat exchangers disposed inside the cold boxes have increased in size to account for the higher cooling demand of larger LNG facilities. Thus, newly-constructed high-capacity LNG facilities utilizing conventional horizontal core-in-kettle heat exchangers require the cold box to be assembled on-site because a pre-assembled cold box would be too large to ship on a standard ocean-going vessel.

In addition to the size/space problems posed by conventional horizontal core-in-kettle heat exchangers, a number of heat transfer inefficiencies can be associated with such horizontal core-in-kettle heat exchangers. For example, the minimal liquid refrigerant depth provided below the core of the exchanger can hamper the availability of liquid refrigerant to the core. Also, the vertical distance between the top of the core and the upper gaseous refrigerant outlet of the shell may be too small to provide adequate disengagement of the gaseous and liquid phases of the refrigerant. When adequate liquid/gas disengagement above the core is not achieved, a significant amount of liquid refrigerant entrained in the upwardly-flowing gaseous refrigerant can undesirably exit the upper gaseous refrigerant outlet of the shell.

OBJECTS AND SUMMARY OF THE INVENTION

It is, therefore, an object of the present invention to provide a novel natural gas liquefaction system that allows more components to be fabricated off-site and then shipped to and assembled at the site of the LNG facility.

A further object of the invention is to provide a cold box configuration utilizing refrigeration components that minimize the dimensions of the cold box.

Another object of the invention is to provide an indirect heat exchange system that overcomes the inefficiencies associated with conventional horizontal core-in-kettle heat exchangers.

It should be understood that the above objects are exemplary and need not all be accomplished by the invention claimed herein. Other objects and advantages of the invention will be apparent from the written description and drawings.

Accordingly, one aspect of the present invention concerns a method of transferring heat from a refrigerant to a cooled fluid. The method comprises: (a) introducing the refrigerant into an internal volume defined within a shell, wherein the internal volume has a height-to-width ratio greater than 1; (b) introducing the cooled fluid into a plate-fin core disposed within the internal volume of the shell; and (c) transferring heat from the cooled fluid in the core to the refrigerant in the shell via indirect heat exchange.

Another aspect of the present invention concerns a process for liquefying a natural gas stream. The process comprises: (a) cooling the natural gas stream via indirect heat exchange with a first refrigerant comprising predominantly propane or propylene; and (b) further cooling the natural gas stream via indirect heat exchange with a second refrigerant comprising predominantly ethane or ethylene, wherein at least a portion of the cooling of steps (a) and/or (b) is carried out in at least one vertical core-in-kettle heat exchanger.

A further aspect of the present invention concerns a heat exchanger comprising a shell defining an internal volume and at least one core disposed in the internal volume. The shell comprises a substantially cylindrical sidewall, a normally-upper end cap, and a normally-lower end cap. The upper and lower end caps are disposed on generally opposite ends of the sidewall. The sidewall defines a fluid inlet for receiving a shell-side fluid into the internal volume. The normally-upper end cap defines a vapor outlet for discharging gas-phase shell-side fluid from the internal volume. The normally-lower end cap defines a liquid outlet for discharging liquid-phase shell-side fluid from the internal volume.

Still another aspect of the present invention concerns a heat exchanger comprising a shell defining an internal volume and a core disposed in the shell. The shell comprises a substantially cylindrical sidewall extending along a central sidewall axis. The core defines a plurality of core-side passageways and a plurality of shell-side passageways. The core-side passageways are fluidly isolated from the internal volume of the shell, while the shell-side passageways present opposite open ends that provide fluid communication with the internal volume of the shell. The shell-side passageways extend in a direction that is substantially parallel to the direction of extension of the sidewall axis so that a thermosiphon effect can be created in the shell-side passageways when the heat exchanger is positioned with the sidewall axis in a substantially upright orientation.

Yet another aspect of the present invention concerns a core-in-kettle heat exchanger system comprising a shell, a plate-fin core disposed in the shell, and a support structure. The shell comprises a substantially cylindrical sidewall extending along a central sidewall axis and the support structure is configured to support the shell in a vertical configuration where the sidewall axis is substantially upright.

Yet a further aspect of the present invention concerns an apparatus comprising a cold box defining an internal volume and a plurality of vertical core-in-kettle heat exchangers disposed in the internal volume of the cold box.

A still further aspect of the present invention concerns a liquefied natural gas facility for cooling a natural gas feed stream by indirect heat exchange with one or more refrigerants. The liquefied natural gas facility comprises a first refrigeration cycle for cooling the natural gas stream via indirect heat exchange with a first refrigerant. The first refrigeration cycle comprises a first vertical core-in-kettle heat exchanger defining a kettle-side volume and a core-side volume fluidly isolated from one another. The kettle-side volume is configured to receive the first refrigerant, while the core-side volume is configured to receive the natural gas stream.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

The present invention was conceived while searching for a solution to the above-described problems stemming from the need for increasingly large cold boxes in high-capacity LNG facilities. However, at least one embodiment of the present invention may find application outside the area of natural gas liquefaction. For example, although the vertical core-in-kettle heat exchanger designs depicted in FIGS. 1-9 are well suited for use in LNG processes/facilities, these heat exchangers exhibit enhanced efficiencies which make their implementation desirable for many other applications requiring indirect heat transfer.

Figure 1:
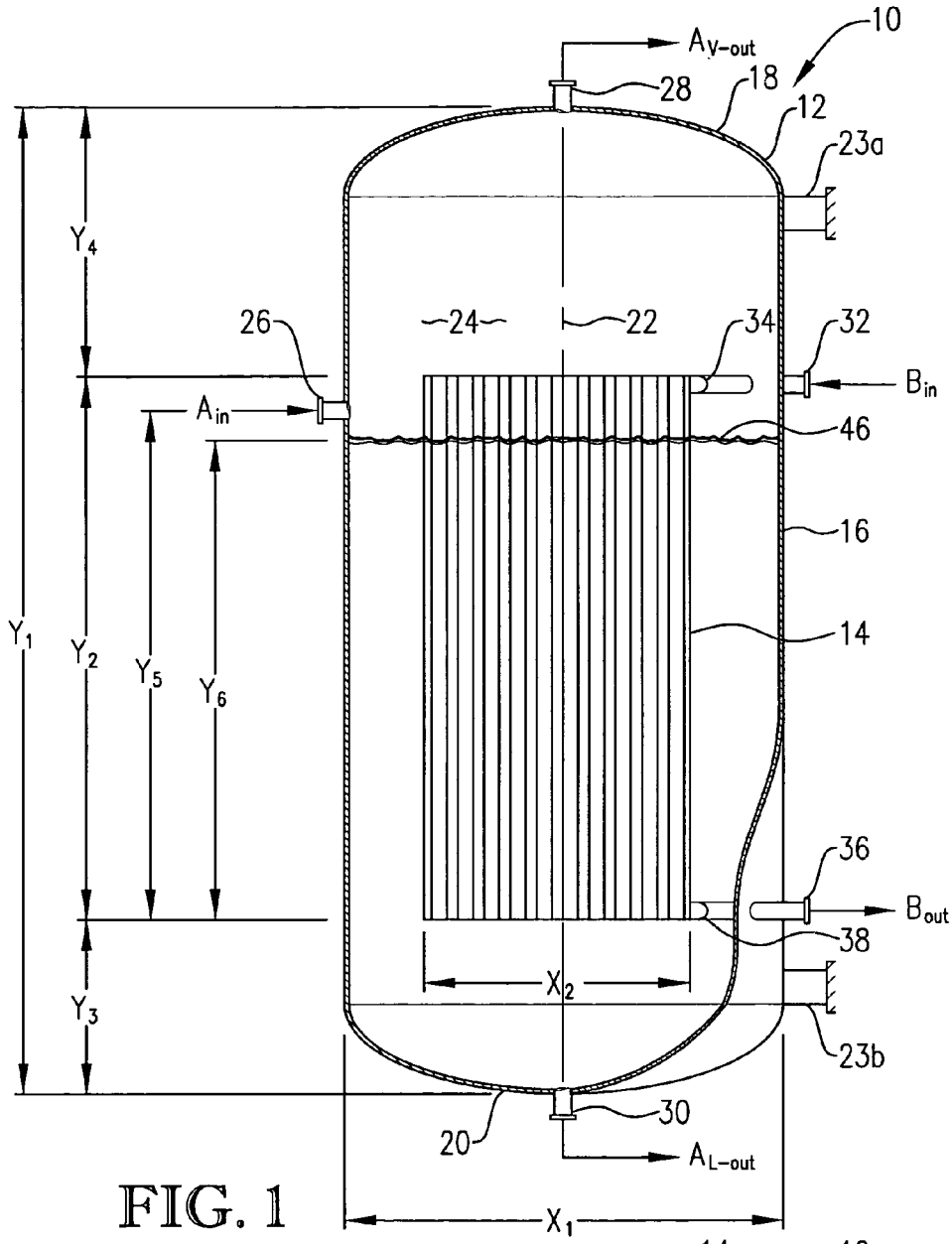
FIG. 1 is a cut-away side view of a vertical core-in-kettle heat exchanger constructed in accordance with the principals of the present invention.

Referring initially to FIG. 1, an inventive vertical core-in-kettle heat exchanger 10 is illustrated as generally comprising a shell 12 and a core 14. Shell 12 includes a substantially cylindrical sidewall 16, an upper end cap 18, and a lower end cap 20. Upper and lower end caps 18,20 are coupled to generally opposite ends of sidewall 16. Sidewall 16 extends along a central sidewall axis 22 that is maintained in a substantially upright position when heat exchanger 10 is in service. Any conventional support system 23*a,b* can be used to maintain the upright orientation of shell 12. Shell 12 defines an internal volume 24 for receiving core 14 and a shell-side fluid (A). Sidewall 16 defines a shell-side fluid inlet 26 for introducing the shell-side fluid feed stream ($A_{in}$) into internal volume 24. Upper end cap 18 defines a vapor outlet 28 for discharging the gaseous/vaporized shell-side fluid ($A_{V\text{-}out}$) from internal volume 24, while lower end cap 20 defines a liquid outlet 30 for discharging the liquid shell-side fluid ($A_{L\text{-}out}$) from internal volume 24.

Core 14 of heat exchanger 10 is disposed in internal volume 24 of shell 12 and is partially submerged in the liquid shell-side fluid (A). Core 14 receives a core-side fluid (B) and facilitates indirect heat transfer between the core-side fluid (B) and the shell-side fluid (A). A core-side fluid inlet 32 extends through sidewall 16 of shell 12 and is fluidly coupled to an inlet header 34 of core 14 to thereby provide for introduction of the core-side fluid feed stream ($B_{in}$) into core 14. A core-side fluid outlet 36 is fluidly coupled to an outlet header 38 of core 14 and extends through sidewall 16 of shell 12 to thereby provide for the discharge of the core-side fluid ($B_{out}$) from core 14.

Figure 2:
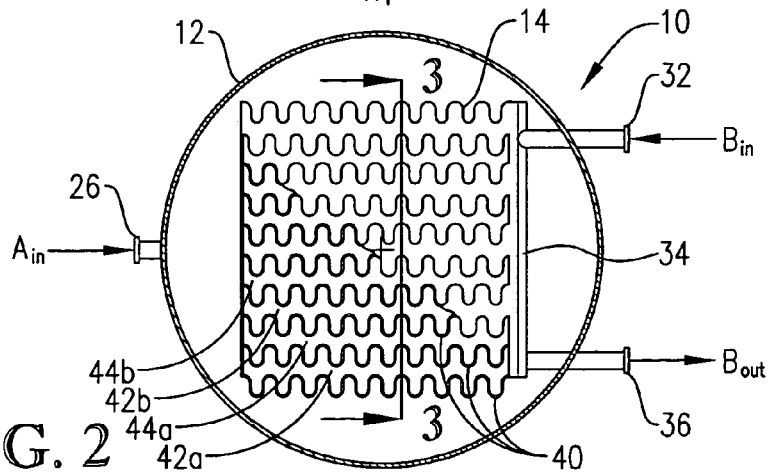
FIG. 2 is a sectional top view of the vertical core-in-kettle heat exchanger of FIG. 1, with the top of the core being partially cut away to more clearly illustrated the alternating shell-side and core-side passageways formed within the core.
Figure 3:
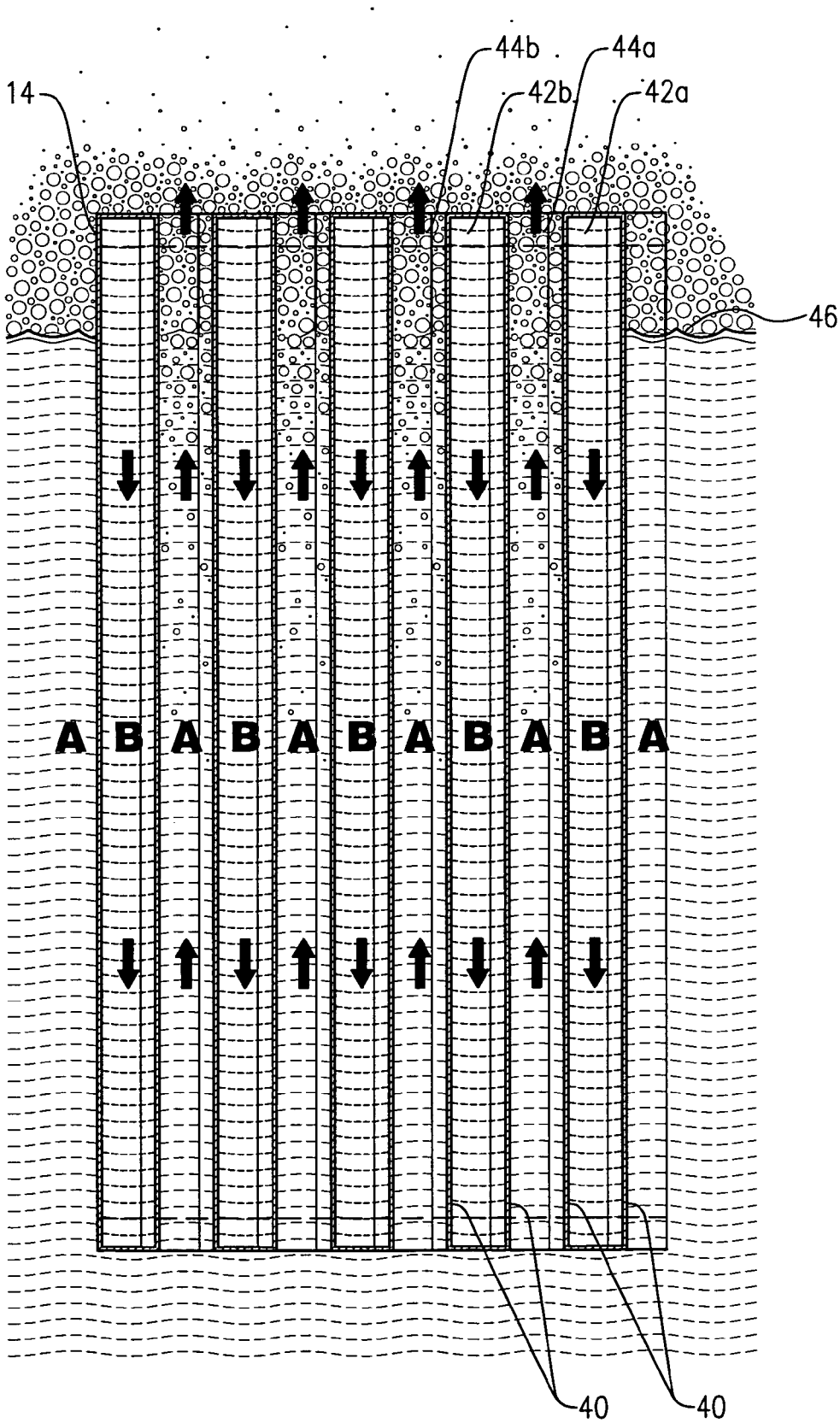
FIG. 3 is a sectional side view taken along line 3-3 in FIG. 2, particularly illustrating the direction of flow of the core-side and shell-side fluids through the core, as well as illustrating the thermosiphon effect caused by the boiling of the shell-side fluid in the core.

As perhaps best illustrated in FIGS. 2 and 3, core 14 preferably comprises a plurality of spaced-apart plate/fin dividers 40 defining fluid passageways therebetween. Preferably, dividers 40 define a plurality of alternating, fluidly-isolated core-side passageways 42*a,b* and shell-side passageways 44*a,b*. Referring to FIGS. 1-3, it is preferred for the core-side and shell-side passageways 42,44 to extend in a direction that is substantially parallel to the direction of extension of central sidewall axis 22. Core-side passageways 42 receive the core-side fluid (B) from inlet header 34 and discharge the core-side fluid (B) into outlet header 38. Shell-side passageways 44 include opposite open ends that provide for fluid communication with internal volume 24 of shell 12.

As illustrated in FIG. 3, the shell-side fluid (A) and the core-side fluid (B) flow in a counter-current manner through shell-side and core side passageways 44,42 of core 14. Preferably, the core-side fluid (B) flows generally downwardly through core-side passageways 42, while the shell-side fluid (A) flows generally upwardly through shell-side passageways 44. The downward flow the core-side fluid (B) through core 14 is provided by any conventional means such as, for example, by mechanically pumping the fluid (B) to core-side fluid inlet 32 (FIG. 1) at elevated pressure. The upward flow of the shell-side fluid (A) through core 14 is provided by a unique mechanism know in the art as the "thermosiphon effect". A thermosiphon effect is caused by the boiling of a liquid within an upright flow channel. When a liquid is heated in an open-ended upright flow channel until the liquid begins to boil, the resulting vapors rise through the flow channel due to natural buoyant forces. This rising of the vapors through the upright flow channel causes a siphoning effect on the liquid in the lower portion of the flow channel. If the lower open end of the flow channel is continuously supplied with liquid, a continuous upward flow of the liquid through the flow channel is provided by this thermosiphon effect.

Referring to FIGS. 1-3, the thermosiphon effect provided in heat exchanger 10 acts as a natural convection pump that circulates the shell-side fluid (A) through and around core 14 to thereby enhance indirect heat exchange in core 14. The thermosiphon effect causes the shell-side fluid (A) to vaporize within shell-side passageways 44 of core 14. In order to generate an optimum thermosiphon effect, a majority of core 14 should be submerged in the liquid shell-side fluid (A) below the liquid surface level 46. In order to ensure proper availability of the liquid shell-side fluid (A) to the lower openings of shell-side passageways 44, it is preferred for a substantial space to be provided between the bottom of core 14 and the bottom of internal volume 24. In order to ensure proper disengagement of the entrained liquid-phase shell side fluid in the gaseous shell-side fluid exiting vapor outlet 28, it is preferred for a substantial space to be provided between the top of core 14 and the top of internal volume 24. In order to ensure proper circulation of the liquid shell-side fluid (A) around core 14, it is preferred for a substantial space to be provided between the sides of core 14 and sidewall 16 of shell 12. The above mentioned advantages may be realized by constructing heat exchanger 10 with the dimensions/ratios illustrated in FIG. 1 and quantified in Table 1, below.

TABLE 1

Preferred Dimensions and Ratios of Heat Exchanger 10 (FIG. 1)

| Dimension or Ratio | Units | Preferred Range | More Preferred Range | Most Preferred Ranged |
|---|---|---|---|---|
| $X_1$ | ft. | 1-30 | 4-20 | 6-15 |
| $X_2$ | ft. | 0.5-20 | 2-15 | 4-10 |
| $Y_1$ | ft. | 2-60 | 6-40 | 8-30 |
| $Y_2$ | ft. | 1-40 | 3-30 | 5-20 |
| $Y_3$ | ft. | >2 | >4 | 5-10 |
| $Y_4$ | ft. | >2 | >4 | 5-10 |
| $Y_1/X_1$ | — | >1 | >1.25 | 1.5-3 |
| $Y_2/X_2$ | — | 0.25-4 | 0.5-2 | 0.75-1.5 |
| $X_2/X_1$ | — | <0.95 | <0.9 | 0.5-0.8 |
| $Y_2/Y_1$ | — | <0.75 | <0.6 | 0.25-0.5 |
| $Y_3/Y_1$ | — | >0.15 | >0.2 | 0.25-0.4 |
| $Y_4/Y_1$ | — | >0.15 | >0.2 | 0.25-0.4 |
| $Y_5/Y_2$ | — | 0.5-1 | 0.6-0.9 | 0.7-0.85 |
| $Y_6/Y_2$ | — | 0.5-0.98 | 0.75-0.95 | 0.8-0.9 |

In FIG. 1, $X_1$ is the maximum width of reaction zone 24 measured perpendicular to the direction of extension of central sidewall axis 22; $X_2$ is the minimum width of core 14 measured perpendicular to the direction of extension of central sidewall axis 22: $Y_1$ is the maximum height of reaction zone 24 measured parallel to the direction of extension of central sidewall axis 22; $Y_2$ is the maximum height of core 14 measured parallel to the direction of extension of central sidewall axis 22; $Y_3$ is the maximum spacing between the bottom of core 14 and the bottom of reaction zone 24 measured parallel to the direction of extension of central sidewall axis 22; and $Y_4$ is the maximum spacing between the top of core 14 and the top of reaction zone 24 measured parallel to the direction of extension of central sidewall axis 22.

In a preferred embodiment of the present invention, heat exchanger 10 is a vertical core-in-kettle heat exchanger and core 14 is a brazed-aluminum, plate-fin core. As used herein, the term "core-in-kettle heat exchanger" shall denote a heat exchanger operable to facilitate indirect heat transfer between a shell-side fluid and a core-side fluid, wherein the heat exchanger comprises a shell for receiving the shell-side fluid and a core disposed in the shell for receiving the core-side fluid, wherein the core defines a plurality of spaced-apart core-side fluid passageways and the shell-side fluid is free to circulate through discrete shell-side passageways defined between the core-side passageways. One distinguishing feature between a core-in-kettle heat exchanger and a shell-and-tube heat exchanger is that a shell-and-tube heat exchanger does not have discrete shell-side passageways between the tubes. The discrete shell-side passageways of a core-in-kettle heat exchanger allow it to take full advantage of the thermosiphon effect. As used herein, the term "vertical core-in-kettle heat exchanger" shall denote a core-in-kettle heat exchanger having a shell that comprises a substantially cylindrical sidewall extending along a central sidewall axis, wherein the central sidewall axis is maintained in a substantially upright position.

Figure 4:
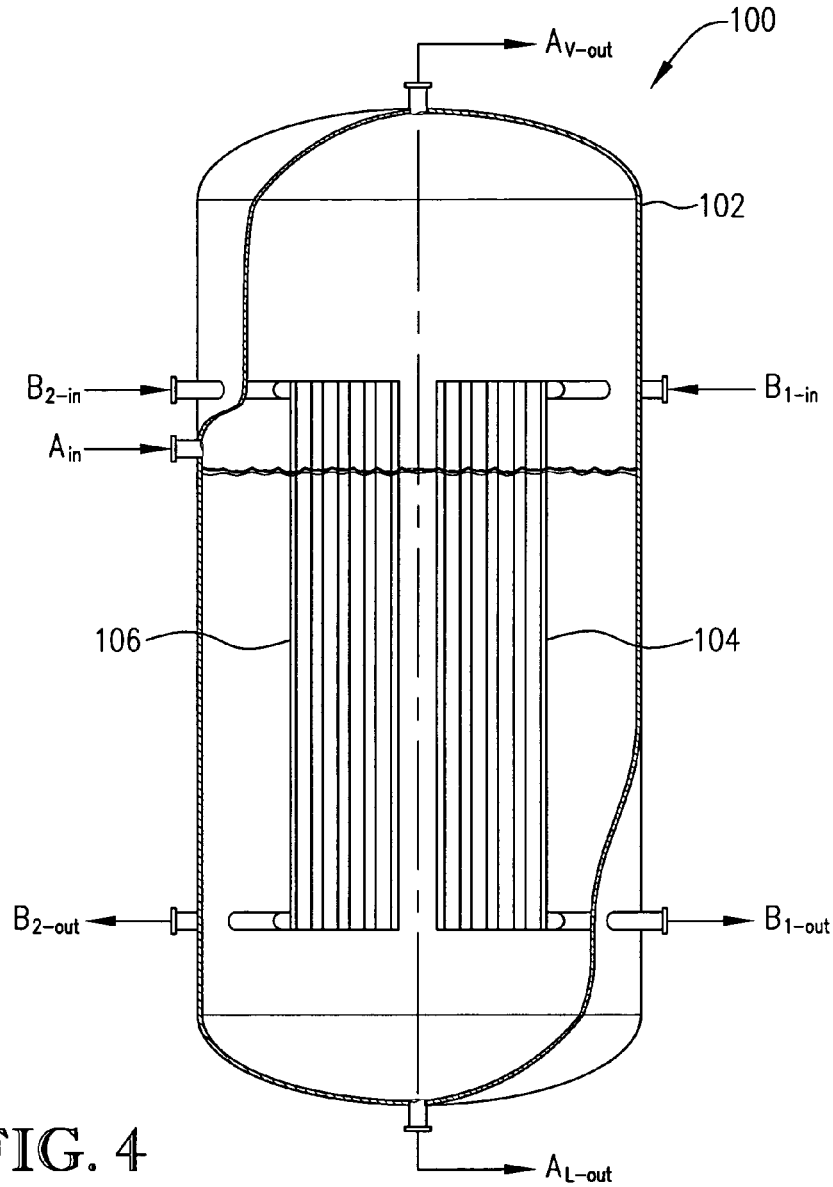
FIG. 4 is a cut-away side view of an alternative vertical core-in-kettle heat exchanger having two separate cores.
Figure 5:
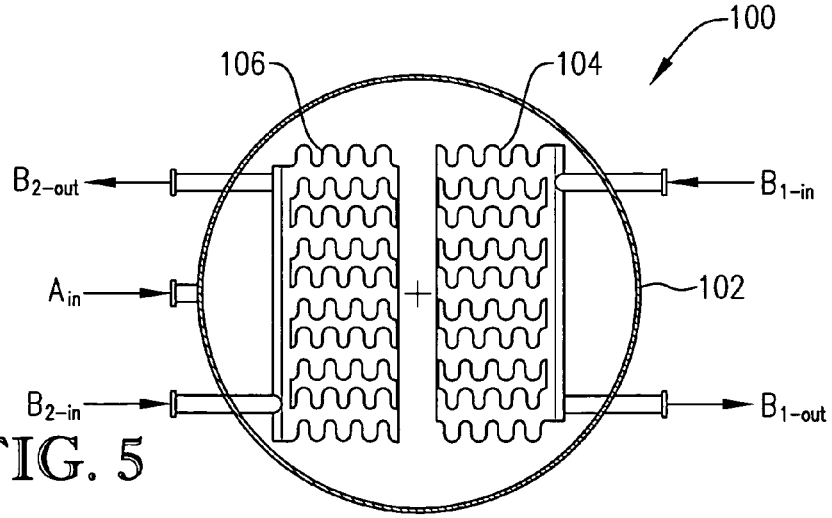
FIG. 5 is a sectional top view of the vertical core-in-kettle heat exchanger of FIG. 4, particularly illustrating the spatial arrangement of the two cores within the shell.

Referring now to FIGS. 4 and 5, an alternative vertical core-in-kettle heat exchanger 100 is illustrated as generally comprising a shell 102, a first core 104, and a second core 106. The two separate cores 104,106 of heat exchanger 100 allow for simultaneous indirect heat transfer between the shell-side fluid (A) and two separate core-side fluids ($B_1$ and $B_2$). It is preferred for cores 104,106 to be disposed side-by-side so that both cores 104,106 are partially submerged in the liquid shell-side fluid (A) during operation. Shell 102 and cores 104,106 of dual-core heat exchanger 100 are preferably configured an a manner similar to that described above with reference to single-core heat exchanger 10 of FIGS. 1-3.

Figure 6:
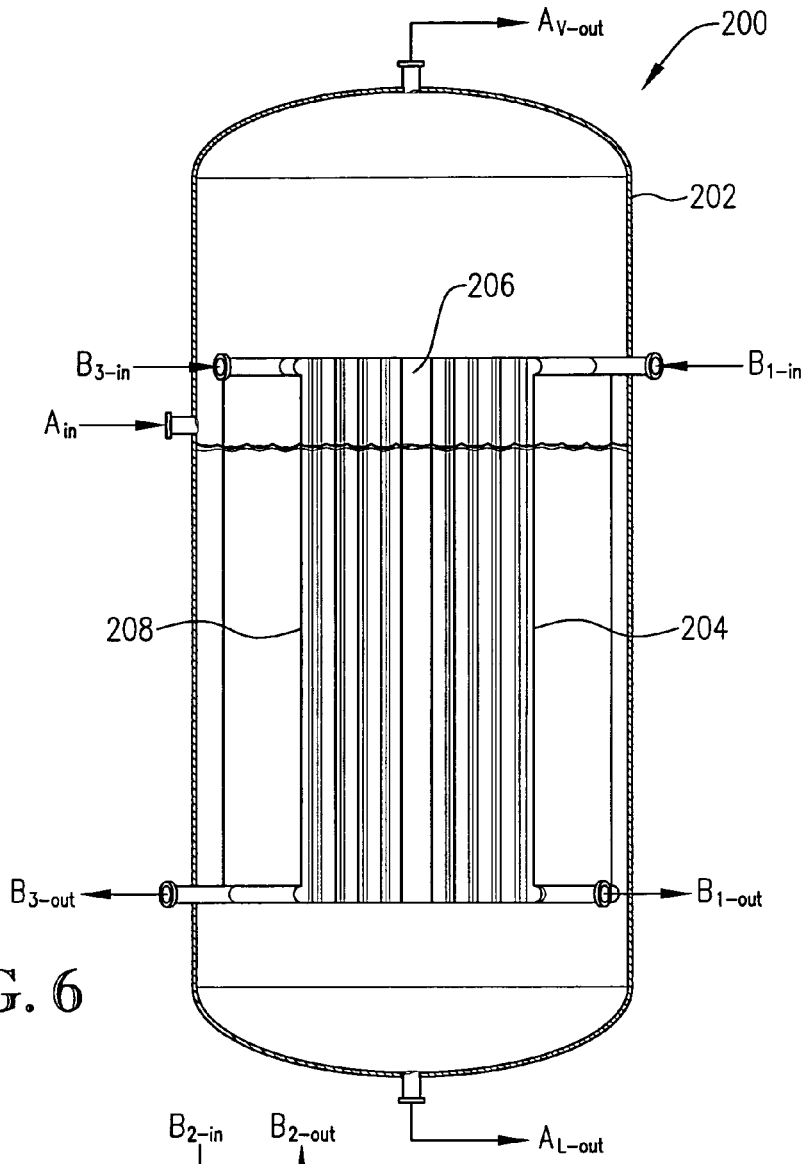
FIG. 6 is a cut-away side view of an alternative vertical core-in-kettle heat exchanger having three separate cores.
Figure 7:
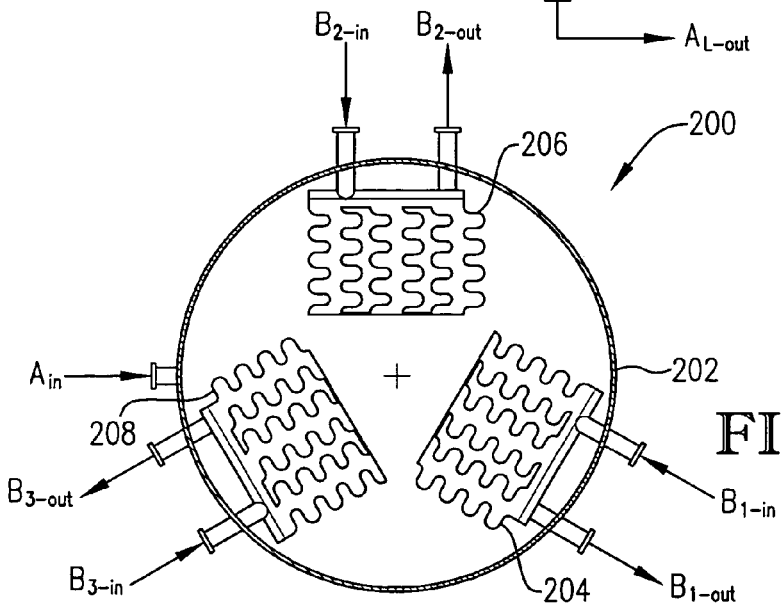
FIG. 7 is a sectional top view of the vertical core-in-kettle heat exchanger of FIG. 6, particularly illustrating the spatial arrangement of the three cores within the shell.

Referring now to FIGS. 6 and 7, an alternative vertical core-in-kettle heat exchanger 200 is illustrated as generally comprising a shell 202, a first core 204, a second core 206, and a third core 208. The three separate cores 204,206,208 of heat exchanger 200 allow for simultaneous indirect heat transfer between the shell-side fluid (A) and three separate core-side fluids ($B_1$, $B_2$, $B_3$). It is preferred for cores 204,206,208 to be disposed side-by-side so that all cores 204,206,208 are partially submerged in the liquid shell-side fluid (A) during operation. Shell 102 and cores 204,206,208 of triple-core heat exchanger 200 are preferably configured an a manner similar to that described above with reference to single-core heat exchanger 10 of FIGS. 1-3.

Figure 8:
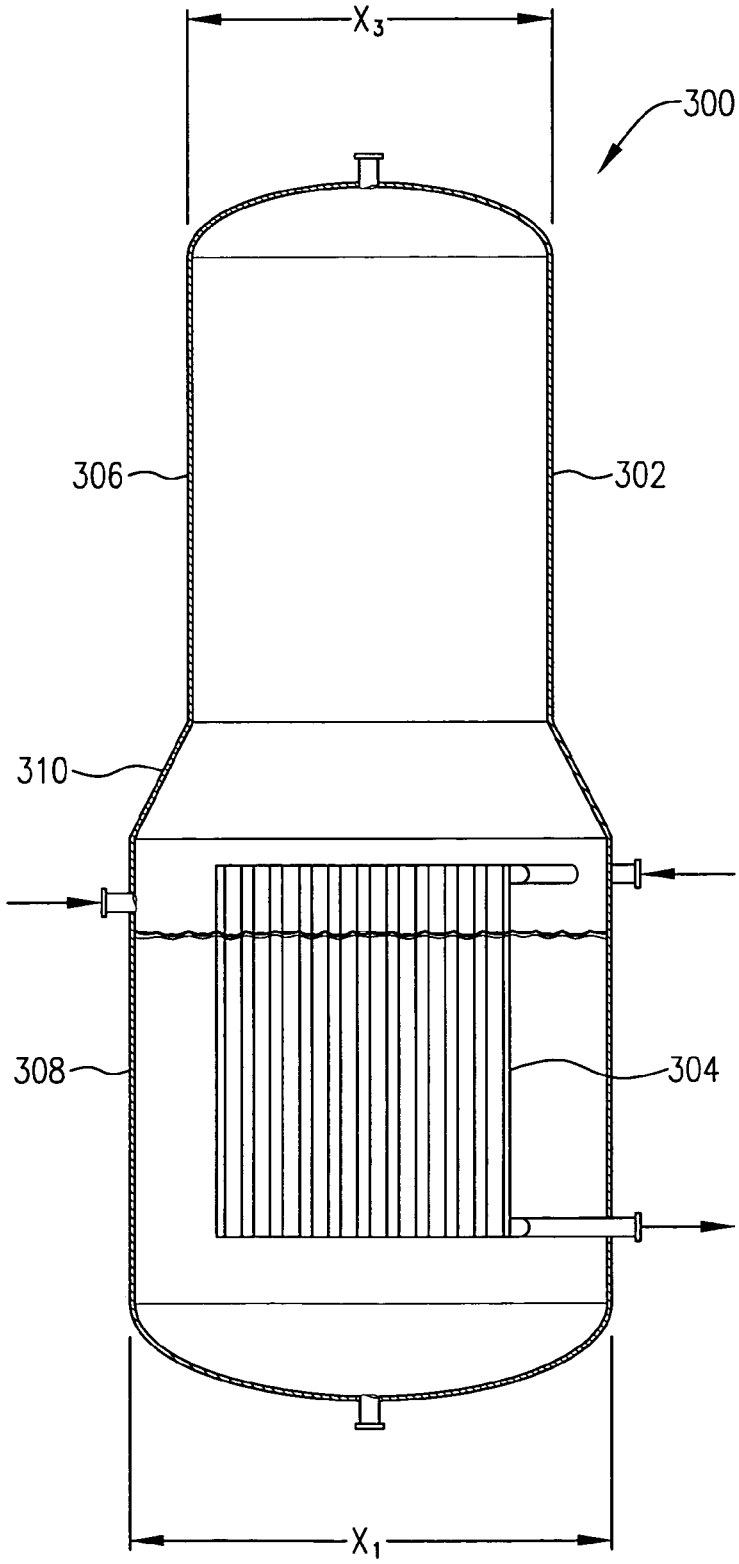
FIG. 8 is a cut-away side view of an alternative vertical core-in-kettle heat exchanger employing a shell having a narrow upper section and a broad lower section.

Referring now to FIG. 8, an alternative vertical core-in-kettle heat exchanger 300 is illustrated as generally comprising a staged shell 302 and a core 304. Staged shell 302 comprises a substantially cylindrical narrow upper section 306, a substantially cylindrical broad lower section 308, and a generally frustoconical transition section 310 connecting the upper and lower sections 306,308. It is preferred for the ratio of the maximum width ($X_1$) of broad of lower section 306 to the maximum width ($X_3$) of narrow upper section 304 to be at least about 1.1:1, more preferably at least about 1.25:1, and most preferably in the range of from 1.5:1 to 2:1. Staged shell 302 of heat exchanger 300 provides more vertical space above core 304 to allow for vapor/liquid disengagement prior to discharge of vapor through the upper outlet of shell 302. In addition, the configuration of heat exchanger 300 lowers the center of gravity of the apparatus.

Figure 9:
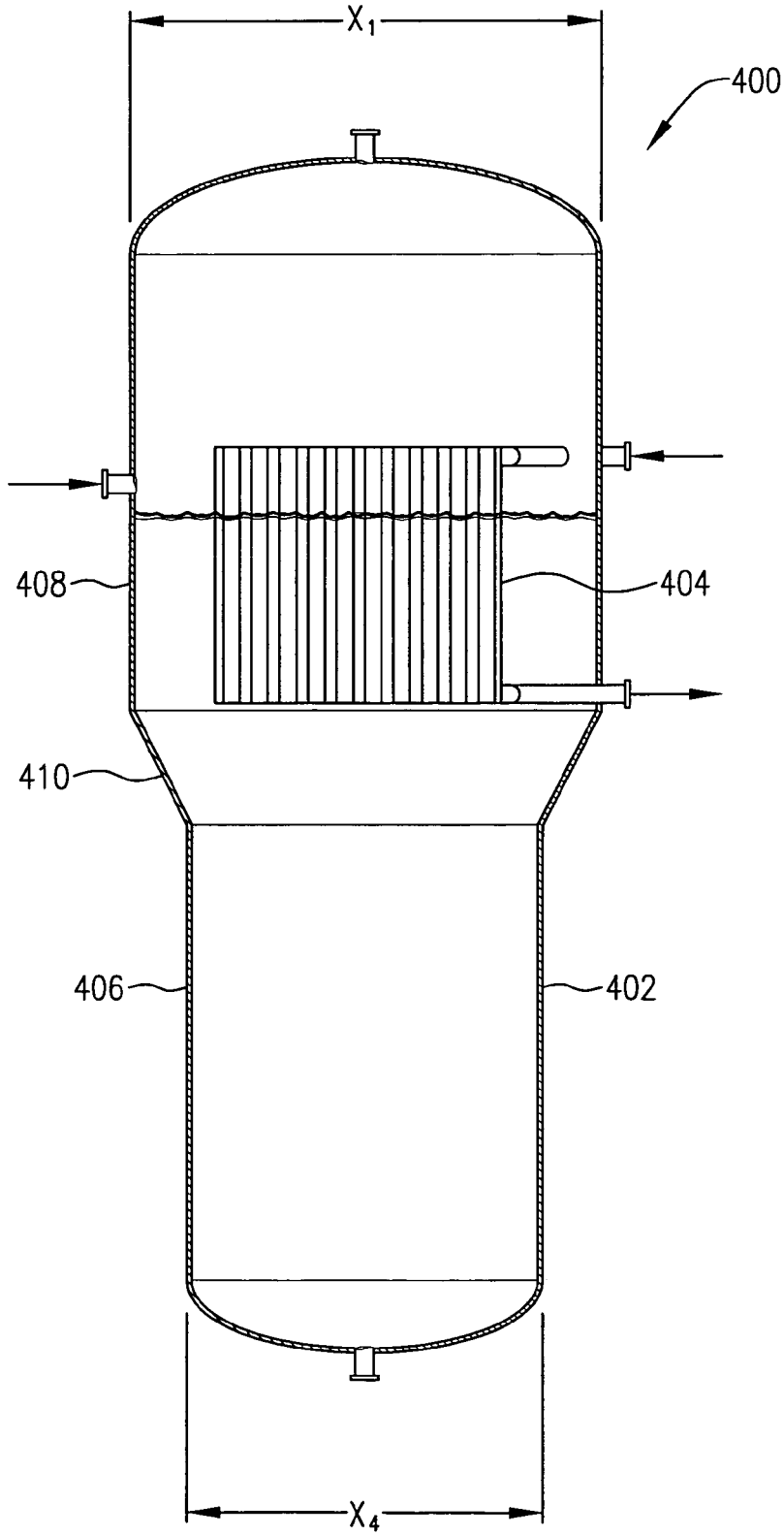
FIG. 9 is a cut-away side view of an alternative vertical core-in-kettle heat exchanger employing a shell having a broad upper section and a narrow lower section.

Referring now to FIG. 9, an alternative vertical core-in-kettle heat exchanger 400 is illustrated as generally comprising a staged shell 402 and a core 404. Staged shell 402 comprises a substantially cylindrical narrow lower section 406, a substantially cylindrical broad upper section 408, and a generally frustoconical transition section 410 connecting the lower and upper sections 406,408. It is preferred for the ratio of the maximum width ($X_1$) of broad upper section 406 to the maximum width ($X_4$) of narrow lower section 404 to be at least about 1.1:1, more preferably at least about 1.25:1, and most preferably in the range of from 1.5:1 to 2:1. Staged shell 402 of heat exchanger 400 provides enhance vapor/liquid disengagement above core 404 because the larger cross sectional are above core 14 minimizes the velocity of the upwardly flowing vapor, thereby allowing the entrained liquid to "fall out" of the vapor before the vapor is discharged through the upper vapor outlet.

In a preferred embodiment of the present invention, one or more of the vertical core-in-kettle heat exchanger configurations illustrated in FIGS. 1-9 are employed in a natural gas liquefaction process to cool natural gas via indirect heat exchange with a refrigerant. When a vertical core-in-kettle heat exchanger is used to a cool natural gas stream, the refrigerant can be employed as the shell-side fluid and the natural gas stream undergoing cooling can be employed as the core-side fluid.

Preferably, one or more of the vertical core-in-kettle heat exchanger configurations described above is employed in a cascade refrigeration process to cool a natural gas stream. A cascaded refrigeration process uses one or more refrigerants for transferring heat energy from the natural gas stream to the refrigerant and ultimately transferring the heat energy to the environment. In essence, the overall cascade refrigeration system functions as a heat pump by removing heat energy from the natural gas stream as the stream is progressively cooled to lower and lower temperatures. The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment, and the proper selection of flow rates through such equipment so as to ensure that both flow rates and approach and outlet temperatures are compatible with the required heating/cooling duty.

As used herein, the term "open-cycle cascaded refrigeration process" refers to a cascaded refrigeration process comprising at least one closed refrigeration cycle and one open refrigeration cycle where the boiling point of the refrigerant/cooling agent employed in the open cycle is less than the boiling point of the refrigerating agent or agents employed in the closed cycle(s) and a portion of the cooling duty to condense the compressed open-cycle refrigerant/cooling agent is provided by one or more of the closed cycles. In the current invention, a predominately methane stream is employed as the refrigerant/cooling agent in the open cycle. This predominantly methane stream originates from the processed natural gas feed stream and can include the compressed open methane cycle gas streams. As used herein, the terms "predominantly", "primarily", "principally", and "in major portion", when used to describe the presence of a particular component of a fluid stream, shall mean that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

One of the most efficient and effective means of liquefying natural gas is via an optimized cascade-type operation in combination with expansion-type cooling. Such a liquefaction process involves the cascade-type cooling of a natural gas stream at an elevated pressure, (e.g., about 650 psia) by sequentially cooling the gas stream via passage through a multistage propane cycle, a multistage ethane or ethylene cycle, and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the terms "upstream" and "downstream" shall be used to describe the relative positions of various components of a natural gas liquefaction plant along the flow path of natural gas through the plant.

Various pretreatment steps provide a means for removing certain undesirable components, such as acid gases, mercaptan, mercury, and moisture from the natural gas feed stream delivered to the LNG facility. The composition of this gas stream may vary significantly. As used herein, a natural gas stream is any stream principally comprised of methane which originates in major portion from a natural gas feed stream, such feed stream for example containing at least 85 mole percent methane, with the balance being ethane, higher hydrocarbons, nitrogen, carbon dioxide, and a minor amount of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily known to one skilled in the art. Acid gases and to a lesser extent mercaptan are routinely removed via a chemical reaction process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure generally greater than 500 psia, preferably about 500 psia to about 3000 psia, still more preferably about 500 psia to about 1000 psia, still yet more preferably about 600 psia to about 800 psia. The feed stream temperature is typically near ambient to slightly above ambient. A representative temperature range being 60° F. to 150° F.

As previously noted, the natural gas feed stream is cooled in a plurality of multistage cycles or steps (preferably three) by indirect heat exchange with a plurality of different refrigerants (preferably three). The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such relatively high boiling point refrigerant is preferably comprised in major portion of propane, propylene, or mixtures thereof, more preferably the refrigerant comprises at least about 75 mole percent propane, even more preferably at least 90 mole percent propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such lower boiling point refrigerant is preferably comprised in major portion of ethane, ethylene, or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is preferably combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety, thereby producing a pressurized LNG-bearing stream. Generally, the process pressure at this location is only slightly lower than the pressure of the pretreated feed gas to the first stage of the first cycle.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much of the $C_2$ and higher molecular weight hydrocarbons as possible from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications, and other factors routinely considered by those skilled in the art of LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycle or can be used as fuel gas. The $C_2$+ hydrocarbon stream or streams or the demethanized $C_2$+ hydrocarbon stream may be used as fuel or may be further processed, such as by fractionation in one or more fractionation zones to produce individual streams rich in specific chemical constituents (e.g., $C_2$, $C_3$, $C_4$, and $C_5$+).

The pressurized LNG-bearing stream is then further cooled in a third cycle or step referred to as the open methane cycle via contact in a main methane economizer with flash gases (i.e., flash gas streams) generated in this third cycle in a manner to be described later and via sequential expansion of the pressurized LNG-bearing stream to near atmospheric pressure. The flash gasses used as a refrigerant in the third refrigeration cycle are preferably comprised in major portion of methane, more preferably the flash gas refrigerant comprises at least 75 mole percent methane, still more preferably at least 90 mole percent methane, and most preferably the refrigerant consists essentially of methane. During expansion of the pressurized LNG-bearing stream to near atmospheric pressure, the pressurized LNG-bearing stream is cooled via at least one, preferably two to four, and more preferably three expansions where each expansion employs an expander as a pressure reduction means. Suitable expanders include, for example, either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash expansion step will frequently more than off-set the higher capital and operating costs associated with the expander. In one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

The liquefaction process described herein may use one of several types of cooling which include but are not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion. Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

Figure 10:
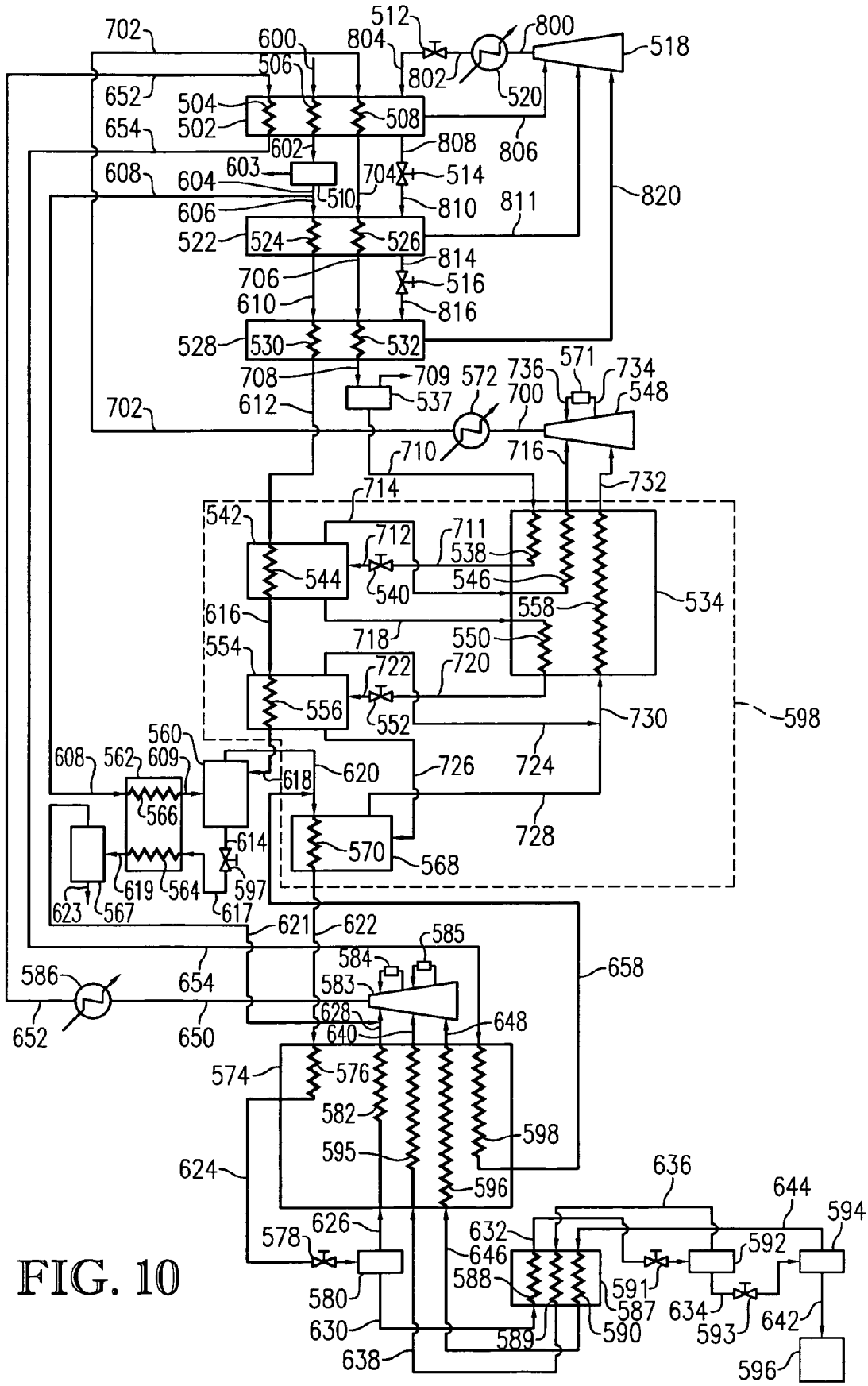
FIG. 10 is a simplified flow diagram of a cascaded refrigeration process for LNG production which employs at least one vertical core-in-kettle heat exchanger to cool the natural gas stream.
Figure 11:
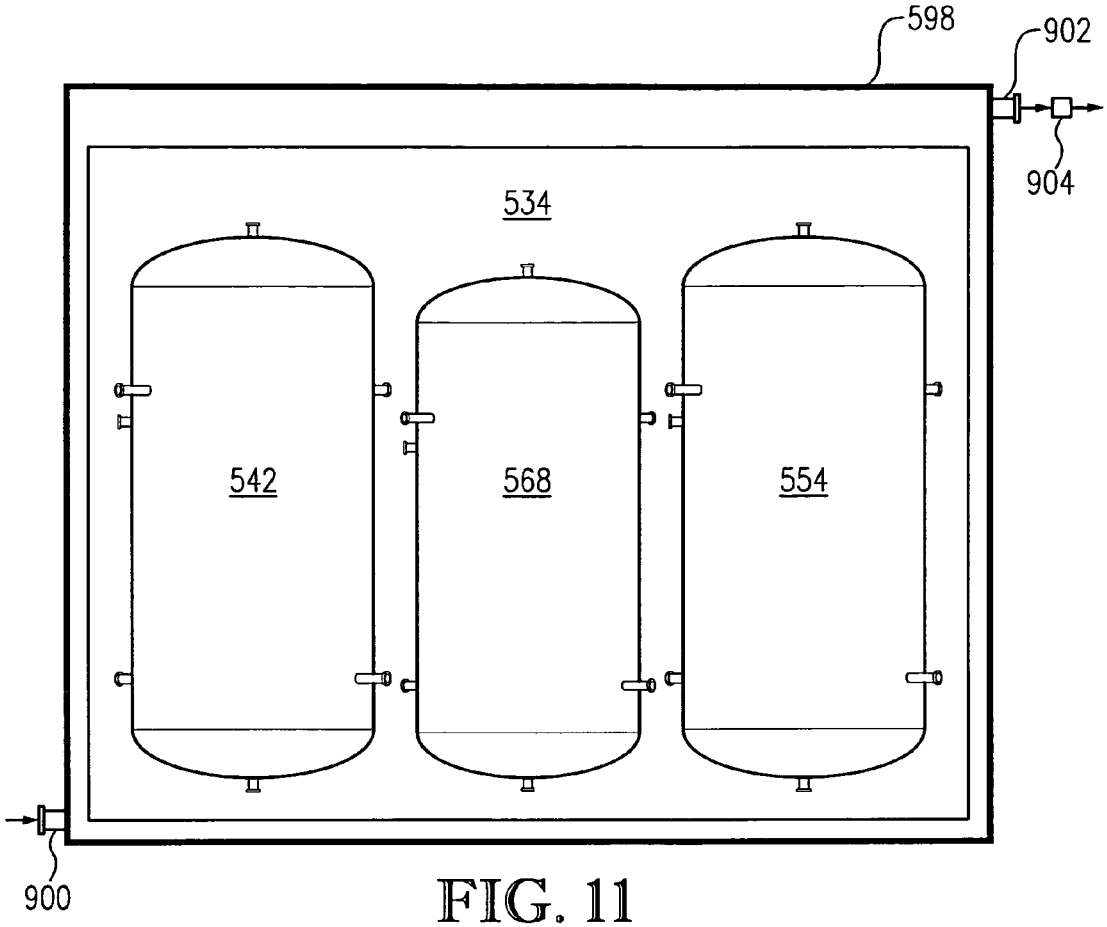
FIG. 11 is a cut-away side view of an ethylene cold box that can be employed in the LNG facility of FIG. 10, particularly illustrating the configuration of the vertical core-in-kettle heat exchangers disposed in the cold box.
Figure 12:
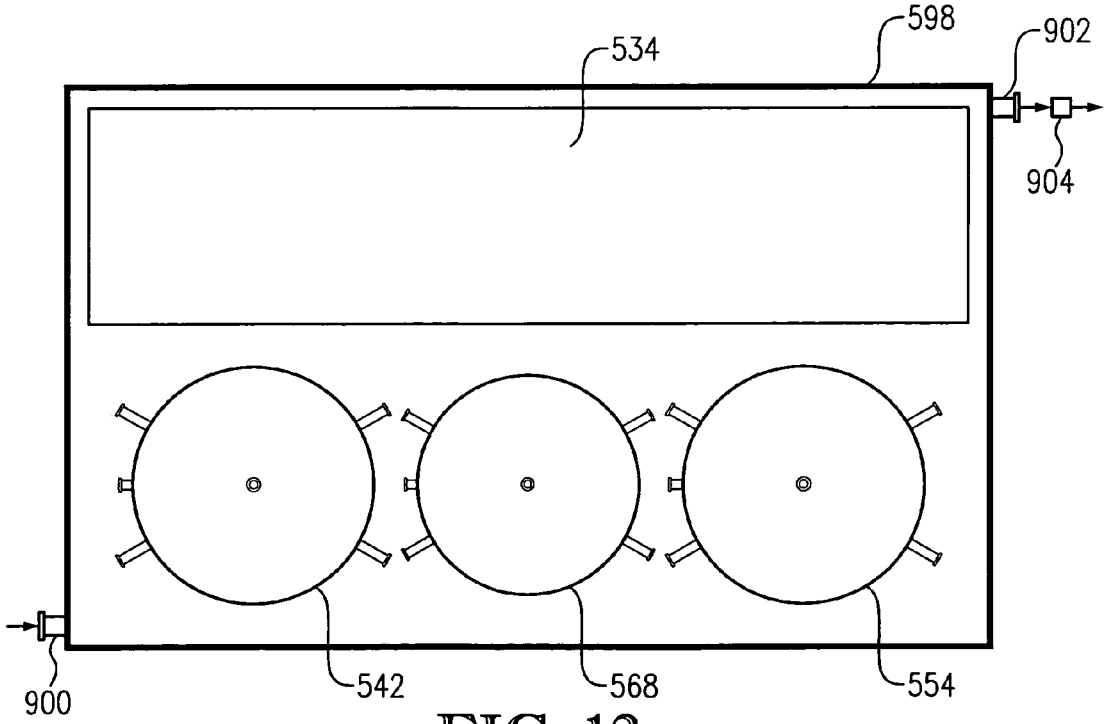
FIG. 12 is a cut-away top view of the ethylene cold box of FIG. 11.

The flow schematic and apparatus set forth in FIG. 10 represents a preferred embodiment of the inventive LNG facility employing one or more vertical core-in-kettle heat exchangers disposed in an optimized cold box. FIGS. 11 and 12 illustrate a preferred embodiment of the optimized cold box containing multiple vertical core-in-kettle heat exchangers. Those skilled in the art will recognized that FIGS. 10-12 are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIGS. 10-12, the following numbering nomenclature was employed. Items numbered 500 through 599 are process vessels and equipment which are directly associated with the liquefaction process. Items numbered 600 through 699 correspond to flow lines or conduits which contain predominantly methane streams. Items numbered 700 through 799 correspond to flow lines or conduits which contain predominantly ethylene streams. Items numbered 800 through 899 correspond to flow lines or conduits which contain predominantly propane streams.

Referring to FIG. 10, gaseous propane is compressed in a multistage (preferably three-stage) compressor 518 driven by a gas turbine driver (not illustrated). The three stages of compression preferably exist in a single unit although each stage of compression may be a separate unit and the units mechanically coupled to be driven by a single driver. Upon compression, the compressed propane is passed through conduit 800 to a cooler 520 where it is cooled and liquefied. A representative pressure and temperature of the liquefied propane refrigerant prior to flashing is about 100° F. and about 190 psia. The stream from cooler 520 is passed through conduit 802 to a pressure reduction means, illustrated as expansion valve 512, wherein the pressure of the liquefied propane is reduced, thereby evaporating or flashing a portion thereof. The resulting two-phase product then flows through conduit 804 into a high-stage propane chiller 502 wherein gaseous methane refrigerant introduced via conduit 652, natural gas feed introduced via conduit 600, and gaseous ethylene refrigerant introduced via conduit 702 are respectively cooled via indirect heat exchange means 504, 506, and 508, thereby producing cooled gas streams respectively produced via conduits 654, 602, and 704. The gas in conduit 654 is fed to a main methane economizer 574 which will be discussed in greater detail in a subsequent section and wherein the stream is cooled via indirect heat exchange means 598. The resulting cooled compressed methane recycle stream produced via conduit 658 is then combined in conduit 620 with the heavies depleted (i.e., light-hydrocarbon rich) vapor stream from a heavies removal column 560 and fed to an ethylene chiller 568.

The propane gas from chiller 502 is returned to compressor 518 through conduit 806. This gas is fed to the high-stage inlet port of compressor 518. The remaining liquid propane is passed through conduit 808, the pressure further reduced by passage through a pressure reduction means, illustrated as expansion valve 514, whereupon an additional portion of the liquefied propane is flashed. The resulting two-phase stream is then fed to an intermediate stage propane chiller 522 through conduit 810, thereby providing a coolant for chiller 522. The cooled feed gas stream from chiller 502 flows via conduit 602 to separation equipment 510 wherein gas and liquid phases are separated. The liquid phase, which can be rich in $C_3$+ components, is removed via conduit 603. The gaseous phase is removed via conduit 604 and then split into two separate streams which are conveyed via conduits 606 and 608. The stream in conduit 606 is fed to propane chiller 522. The stream in conduit 608 becomes the feed to heat exchanger 562 and ultimately becomes the stripping gas to heavies removal column 560, discussed in more detail below. Ethylene refrigerant from chiller 502 is introduced to chiller 522 via conduit 704. In chiller 522, the feed gas stream, also referred to herein as a methane-rich stream, and the ethylene refrigerant streams are respectively cooled via indirect heat transfer means 524 and 526, thereby producing cooled methane-rich and ethylene refrigerant streams via conduits 610 and 706. The thus evaporated portion of the propane refrigerant is separated and passed through conduit 811 to the intermediate-stage inlet of compressor 518. Liquid propane refrigerant from chiller 522 is removed via conduit 814, flashed across a pressure reduction means, illustrated as expansion valve 516, and then fed to a low-stage propane chiller/condenser 528 via conduit 816.

As illustrated in FIG. 10, the methane-rich stream flows from intermediate-stage propane chiller 522 to the low-stage propane chiller 528 via conduit 610. In chiller 528, the stream is cooled via indirect heat exchange means 530. In a like manner, the ethylene refrigerant stream flows from the intermediate-stage propane chiller 522 to low-stage propane chiller 528 via conduit 706. In the latter, the ethylene refrigerant is totally condensed or condensed in nearly its entirety via indirect heat exchange means 532. The vaporized propane is removed from low-stage propane chiller 528 and returned to the low-stage inlet of compressor 518 via conduit 820.

As illustrated in FIG. 10, the methane-rich stream exiting low-stage propane chiller 528 is introduced to high-stage ethylene chiller 542 via conduit 612. Ethylene refrigerant exits low-stage propane chiller 528 via conduit 708 and is preferably fed to a separation vessel 537 wherein light components are removed via conduit 709 and condensed ethylene is removed via conduit 710. The ethylene refrigerant at this location in the process is generally at a temperature of about −24° F. and a pressure of about 285 psia. The ethylene refrigerant then flows to an ethylene economizer 534 wherein it is cooled via indirect heat exchange means 538, removed via conduit 711, and passed to a pressure reduction means, illustrated as an expansion valve 540, whereupon the refrigerant is flashed to a preselected temperature and pressure and fed to high-stage ethylene chiller 542 via conduit 712. Vapor is removed from chiller 542 via conduit 714 and routed to ethylene economizer 534 wherein the vapor functions as a coolant via indirect heat exchange means 546. The ethylene vapor is then removed from ethylene economizer 534 via conduit 716 and fed to the high-stage inlet of ethylene compressor 548. The ethylene refrigerant which is not vaporized in high-stage ethylene chiller 542 is removed via conduit 718 and returned to ethylene economizer 534 for further cooling via indirect heat exchange means 550, removed from ethylene economizer via conduit 720, and flashed in a pressure reduction means, illustrated as expansion valve 552, whereupon the resulting two-phase product is introduced into a low-stage ethylene chiller 554 via conduit 722.

After cooling in indirect heat exchange means 544, the methane-rich stream is removed from high-stage ethylene chiller 542 via conduit 616. This stream is then condensed in part via cooling provided by indirect heat exchange means 556 in low-stage ethylene chiller 554, thereby producing a two-phase stream which flows via conduit 618 to heavies removal column 560. As previously noted, the methane-rich stream in line 604 was split so as to flow via conduits 606 and 608. The contents of conduit 608, which is referred to herein as the stripping gas, is first fed to heat exchanger 562 wherein this stream is cooled via indirect heat exchange means 566 thereby becoming a cooled stripping gas stream which then flows via conduit 609 to heavies removal column 560. A heavies-rich liquid stream containing a significant concentration of $C_4$+ hydrocarbons, such as benzene, cyclohexane, other aromatics, and/or heavier hydrocarbon components, is removed from heavies removal column 560 via conduit 614, preferably flashed via a flow control means 597, preferably a control valve which can also function as a pressure reduction means, and transported to heat exchanger 562 via conduit 617. Preferably, the stream flashed via flow control means 597 is flashed to a pressure about or greater than the pressure at the high stage inlet port to methane compressor 583. Flashing also imparts greater cooling capacity to the stream. In heat exchanger 562, the stream delivered by conduit 617 provides cooling capabilities via indirect heat exchange means 564 and exits heat exchanger 562 via conduit 619. In heavies removal column 560, the two-phase stream introduced via conduit 618 is contacted with the cooled stripping gas stream introduced via conduit 609 in a countercurrent manner thereby producing a heavies-depleted vapor stream via conduit 620 and a heavies-rich liquid stream via conduit 614.

The heavies-rich stream in conduit 619 is subsequently separated into liquid and vapor portions or preferably is flashed or fractionated in vessel 567. In either case, a heavies-rich liquid stream is produced via conduit 623 and a second methane-rich vapor stream is produced via conduit 621. In the preferred embodiment, which is illustrated in FIG. 10, the stream in conduit 621 is subsequently combined with a second stream delivered via conduit 628, and the combined stream fed to the high-stage inlet port of the methane compressor 583.

As previously noted, the gas in conduit 654 is fed to main methane economizer 574 wherein the stream is cooled via indirect heat exchange means 598. The resulting cooled compressed methane recycle or refrigerant stream in conduit 658 is combined in the preferred embodiment with the heavies-depleted vapor stream from heavies removal column 560, delivered via conduit 620, and fed to a low-stage ethylene chiller 568. In low-stage ethylene chiller 568, this stream is cooled and condensed via indirect heat exchange means 570 with the liquid effluent from low-stage ethylene chiller 554 is routed to ethylene condenser 568 via conduit 726. The condensed methane-rich product from condenser 568 is produced via conduit 622. The vapor from ethylene chiller 554, withdrawn via conduit 724, and ethylene condenser 568, withdrawn via conduit 728, are combined and routed, via conduit 730, to ethylene economizer 534 wherein the vapors function as a coolant via indirect heat exchange means 558. The stream is then routed via conduit 732 from ethylene economizer 534 to the low-stage inlet of ethylene compressor 548.

As noted in FIG. 10, the compressor effluent from vapor introduced via the low-stage side of ethylene compressor 548 is removed via conduit 734, cooled via inter-stage cooler 571, and returned to compressor 548 via conduit 736 for injection with the high-stage stream present in conduit 716. Preferably, the two-stages are a single module although they may each be a separate module and the modules mechanically coupled to a common driver. The compressed ethylene product from compressor 548 is routed to a downstream cooler 572 via conduit 700. The product from cooler 572 flows via conduit 702 and is introduced, as previously discussed, to high-stage propane chiller 502.

The pressurized LNG-bearing stream, preferably a liquid stream in its entirety, in conduit 622 is preferably at a temperature in the range of from about −200 to about −50° F., more preferably in the range of from about −175 to about −100° F., most preferably in the range of from −150 to −125° F. The pressure of the stream in conduit 622 is preferablyin the range of from about 500 to about 700 psia, most preferably in the range of from 550 to 725 psia.

The stream in conduit 622 is directed to a main methane economizer 574 wherein the stream is further cooled by indirect heat exchange means/heat exchanger pass 576 as hereinafter explained. It is preferred for main methane economizer 574 to include a plurality of heat exchanger passes which provide for the indirect exchange of heat between various predominantly methane streams in the economizer 574. Preferably, methane economizer 574 comprises one or more plate-fin heat exchangers. The cooled stream from heat exchanger pass 576 exits methane economizer 574 via conduit 624. It is preferred for the temperature of the stream in conduit 624 to be at least about 10° F. less than the temperature of the stream in conduit 622, more preferably at least about 25° F. less than the temperature of the stream in conduit 622. Most preferably, the temperature of the stream in conduit 624 is in the range of from about −200 to about −160° F. The pressure of the stream in conduit 624 is then reduced by a pressure reduction means, illustrated as expansion valve 578, which evaporates or flashes a portion of the gas stream thereby generating a two-phase stream. The two-phase stream from expansion valve 578 is then passed to high-stage methane flash drum 580 where it is separated into a flash gas stream discharged through conduit 626 and a liquid phase stream (i.e., pressurized LNG-bearing stream) discharged through conduit 630. The flash gas stream is then transferred to main methane economizer 574 via conduit 626 wherein the stream functions as a coolant in heat exchanger pass 582 and aids in the cooling of the stream in heat exchanger pass 576. Thus, the predominantly methane stream in heat exchanger pass 582 is warmed, at least in part, by indirect heat exchange with the predominantly methane stream in heat exchanger pass 576. The warmed stream exits heat exchanger pass 582 and methane economizer 574 via conduit 628. It is preferred for the temperature of the warmed predominantly methane stream exiting heat exchanger pass 582 via conduit 628 to be at least about 10° F. greater than the temperature of the stream in conduit 624, more preferably at least about 25° F. greater than the temperature of the stream in conduit 624. The temperature of the stream exiting heat exchanger pass 582 via conduit 628 is preferably warmer than about −50° F., more preferably warmer than about 0° F., still more preferably warmer than about 25° F., and most preferably in the range of from 40 to 100° F.

The liquid-phase stream exiting high-stage flash drum 580 via conduit 630 is passed through a second methane economizer 587 wherein the liquid is further cooled by downstream flash vapors via indirect heat exchange means 588. The cooled liquid exits second methane economizer 587 via conduit 632 and is expanded or flashed via pressure reduction means, illustrated as expansion valve 591, to further reduce the pressure and, at the same time, vaporize a second portion thereof. This two-phase stream is then passed to an intermediate-stage methane flash drum 592 where the stream is separated into a gas phase passing through conduit 636 and a liquid phase passing through conduit 634. The gas phase flows through conduit 636 to second methane economizer 587 wherein the vapor cools the liquid introduced to economizer 587 via conduit 630 via indirect heat exchanger means 589. Conduit 638 serves as a flow conduit between indirect heat exchange means 589 in second methane economizer 587 and heat exchanger pass 595 in main methane economizer 574. The warmed vapor stream from heat exchanger pass 595 exits main methane economizer 574 via conduit 640 and is conducted to the intermediate-stage inlet of methane compressor 583.

The liquid phase exiting intermediate-stage flash drum 592 via conduit 634 is further reduced in pressure by passage through a pressure reduction means, illustrated as a expansion valve 593. Again, a third portion of the liquefied gas is evaporated or flashed. The two-phase stream from expansion valve 593 is passed to a final or low-stage flash drum 594. In flash drum 594, a vapor phase is separated and passed through conduit 644 to second methane economizer 587 wherein the vapor functions as a coolant via indirect heat exchange means 590, exits second methane economizer 587 via conduit 646, which is connected to the first methane economizer 574 wherein the vapor functions as a coolant via heat exchanger pass 596. The warmed vapor stream from heat exchanger pass 596 exits main methane economizer 574 via conduit 648 and is conducted to the low-stage inlet of compressor 583.

The liquefied natural gas product from low-stage flash drum 594, which is at approximately atmospheric pressure, is passed through conduit 642 to a LNG storage tank 599. In accordance with conventional practice, the liquefied natural gas in storage tank 599 can be transported to a desired location (typically via an ocean-going LNG tanker). The LNG can then be vaporized at an onshore LNG terminal for transport in the gaseous state via conventional natural gas pipelines.

As shown in FIG. 10, the high, intermediate, and low stages of compressor 583 are preferably combined as single unit. However, each stage may exist as a separate unit where the units are mechanically coupled together to be driven by a single driver. The compressed gas from the low-stage section passes through an inter-stage cooler 585 and is combined with the intermediate pressure gas in conduit 640 prior to the second-stage of compression. The compressed gas from the intermediate stage of compressor 583 is passed through an inter-stage cooler 584 and is combined with the high pressure gas provided via conduits 621 and 628 prior to the third-stage of compression. The compressed gas (i.e., compressed open methane cycle gas stream) is discharged from high stage methane compressor through conduit 650, is cooled in cooler 586, and is routed to the high pressure propane chiller 502 via conduit 652 as previously discussed. The stream is cooled in chiller 502 via indirect heat exchange means 504 and flows to main methane economizer 574 via conduit 654. The compressed open methane cycle gas stream from chiller 502 which enters the main methane economizer 574 undergoes cooling in its entirety via flow through indirect heat exchange means 598. This cooled stream is then removed via conduit 658 and combined with the processed natural gas feed stream upstream of the first stage of ethylene cooling.

The LNG facility illustrated in FIG. 10 preferably includes an ethylene cold box 598 (depicted with dashed lines). As used herein the term "cold box" shall denote an insulated enclosure housing a plurality of components within which a relatively cold fluid stream is processed. As used herein, the term "ethylene cold box" shall denote a cold box within which predominately ethylene refrigerant streams are employed to cool a natural gas stream.

As shown schematically in FIGS. 10-12, ethylene cold box 598 preferably houses ethylene economizer 534, high-stage ethylene chiller 542, low-stage ethylene chiller 554, ethylene condenser 568, and various conduits and valves associated with the ethylene refrigeration cycle. FIGS. 11 and 12 illustrate that the chillers 542,554 and condenser 568 can be vertical core-in-kettle heat exchangers having a configuration described above with reference to FIGS. 1-9. Employing vertical heat exchangers in cold box 598 allows cold box 598 to have a smaller plot space. In addition, vertical core-in-kettle heat exchangers can provide the enhance heat transfer efficiencies discussed above.

As shown in FIGS. 11 and 12, ethylene cold box 598 preferably includes a purging gas inlet 900 and a purging gas outlet 902. In order to ensure that no water accumulates in ethylene cold box 598, a substantially hydrocarbon-free purging gas is continuously introduced via inlet 900 into ethylene cold box 598. The purging gas flows through the interior of cold box 598 and exits cold box 598 via outlet 902. The purging gas exiting cold box 598 via outlet 902 is carried to a hydrocarbon analyzer 904. Hydrocarbon analyzer 904 is operable to detect the presence of hydrocarbons in the purging gas. If analyzer 904 detects an unusually high hydrocarbon concentration in the purging gas, this indicates a hydrocarbon leak within ethylene cold box 598.

Although only one cold box (i.e., ethylene cold box 598) is illustrated in the LNG facility of FIG. 10, the LNG facility may employ other cold boxes that house vertical core-in-kettle heat exchangers. For example, various components of the methane refrigeration cycle may be disposed in a methane cold box. In addition, although FIGS. 10-12 only illustrate that ethylene chillers/condensers 542,554,568 are vertical core-in-kettle heat exchangers, the inventive LNG facility of FIG. 10 may employ vertical core-in-kettle heat exchangers at a variety of other locations where indirect heat transfer is required. For example, one or more of the propane chillers 502,522,528 can employ a vertical heat exchanger having the configuration described above with reference to FIGS. 1-9.

In one embodiment of the present invention, the LNG production system illustrated in FIG. 10 is simulated on a computer using conventional process simulation software. Examples of suitable simulation software include HYSYS™ from Hyprotech, Aspen Plus® from Aspen Technology, Inc., and PRO/II® from Simulation Sciences Inc.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method of transferring heat from a refrigerant to a cooled fluid, said method comprising:

(a) introducing the refrigerant into an internal volume defined within a shell, said internal volume having a height-to-width ratio greater than 1;

(b) introducing the cooled fluid into a plate-fin core disposed within the internal volume of the shell;

(c) transferring heat from the cooled fluid in the core to the refrigerant in the shell via indirect heat exchange; and (d) withdrawing a predominantly liquid stream of the refrigerant from a liquid outlet defined in the shell at a lower elevation than the bottom of the core, wherein the ratio of the vertical distance between the bottom of the core and the liquid outlet to the maximum height of the internal volume is greater than about 0.15, said core being spaced from the top and bottom of the shell, said core defining a plurality of generally upwardly extending shell-side flow passageways for receiving said refrigerant, each of said passageways defining a downwardly facing lower refrigerant inlet and an upwardly facing upper refrigerant outlet.

2. The method according to claim 1, said height-to-width ratio being at least about 1.25.

3. The method according to claim 1, step (c) including vaporizing at least a portion of said refrigerant in said shell-side passageways.

4. The method according to claim 3, said vaporizing of step (c) causing a thermosiphon effect in the core.

5. The method according to claim 1; and (e) maintaining the level of liquid-phase refrigerant in said shell at an elevation where at least 50% of the height of the core is submerged in the liquid-phase refrigerant.

6. The method according to claim 5, step (e) including maintaining the level of liquid-phase refrigerant in the shell at an elevation where 75-95% of the height of the core is submerged in the liquid-phase refrigerant.

7. The method according to claim 6, step (a) including introducing said refrigerant into the internal volume at a location above the level of liquid-phase refrigerant in the shell.

8. The method according to claim 1; and (f) removing a gas-phase refrigerant from an upper outlet of the shell.

9. The method according to claim 1, said shell including a substantially cylindrical sidewall extending along a central sidewall axis, said sidewall axis being substantially upright.

10. The method according to claim 9, said height-to-width ratio being at least about 1.25.

11. The method according to claim 9, said core defining a plurality of core-side passageways for receiving the cooled fluid, said core defining a plurality of shell-side passageways for receiving the refrigerant, each of said shell-side passageways extending generally upwardly between a lower refiigerant inlet and an upper refrigerant outlet.

12. The method according to claim 11,
step (c) including vaporizing at least a portion of the refrigerant in the shell-side passageways.
13. The method according to claim 12,
said vaporizing causing natural upward convection of the refrigerant through the shell-side passageways.
14. The method according to claim 1,
said core being spaced from the sides of the shell.
15. The method according to claim 1,
said internal volume having a maximum height (H),
said core being spaced from the bottom of the internal volume by at least 0.2 H,
said core being spaced from the top of the internal volume by at least 0.2 H.
16. The method according to claim 1,
said cooled fluid comprising predominantly methane,
said refrigerant comprising predominantly propane, propylene, ethane, ethylene, methane, or carbon dioxide.
17. The method according to claim 1,
said cooled fluid being a natural gas stream,
said refrigerant comprising predominantly propane or ethylene.
18. A process for liquefying a natural gas stream, said process comprising:
(a) cooling the natural gas stream via indirect heat exchange with a first refrigerant comprising predominantly propane or propylene; and
(b) further cooling the natural gas stream via indirect heat exchange with a second refrigerant comprising predominantly ethane or ethylene,
at least a portion of said cooling of steps (a) and/or (b) being carried out in at least one vertical core-in-kettle heat exchanger,
said heat exchanger comprising a shell defining a kettle volume and a plate-fin core disposed in said kettle volume,
said core being spaced from the top and bottom of said shell,
said core defining a plurality of generally upwardly extending shell-side passageways,
each of said passageways defining a downwardly facing lower inlet and an upwardly facing upper outlet,
said shell defining a liquid outlet at a lower elevation than the bottom of the core,
wherein the ratio of the vertical distance between the bottom of the core and the liquid outlet to the maximum height of the kettle volume is greater than about 0.15.
19. The process according to claim 18,
said shell comprising a substantially cylindrical sidewall extending along a central sidewall axis,
said heat exchanger being positioned so that the sidewall axis has a substantially upright orientation.
20. The process according to claim 19,
said core defining a plurality of generally upwardly extending core-side passageways,
said natural gas stream being received in the core-side passageways,
said first or second refrigerant being received in the shell-side passageways.
21. The process according to claim 20,
said core defining alternating core-side and shell-side passageways.
22. The process according to claim 20,
said cooling of steps (a) and/or (b) including causing at least a portion of the first refrigerant in the shell-side passageways to vaporize, thereby providing a thermosiphon effect.
23. The process according to claim 19,
said shell defining an internal volume having a maximum height (H),
said core being spaced from the top of the internal volume by at least 0.2 H,
said core being spaced from the bottom of the internal volume by at least 0.2 H.
24. The process according to claim 23,
said core being spaced from the sidewall of the shell.
25. The process according to claim 18; and
(c) further cooling the natural gas stream via indirect heat exchange with a third refrigerant comprising predominantly methane.
26. The process according to claim 25; and
(d) flashing at least a portion of the natural gas stream to thereby provide gas-phase natural gas,
step (c) including using at least a portion of the gas-phase natural gas as the third refrigerant.
27. The process according to claim 26,
said first refrigerant comprising predominantly propane,
said second refrigerant comprising predominantly ethylene.
28. The process according to claim 18; and
(e) vaporizing liquefied natural gas produced by the process of steps (a) and (b).
29. A heat exchanger comprising:
a shell defining an internal volume; and
at least one core disposed in the internal volume,
said shell comprising a substantially cylindrical sidewall, a normally-upper end cap, and a normally-lower end cap, said upper and lower end caps being disposed on generally opposite ends of the sidewall,
said sidewall defining a fluid inlet for receiving a shell-side fluid into the internal volume,
said normally-upper end cap defining a vapor outlet for discharging gas-phase shell-side fluid from the internal volume,
said normally-lower end cap defining a liquid outlet for discharging liquid-phase shell-side fluid from the internal volume.
30. The heat exchanger according to claim 29,
said core being a plate-fin core.
31. The heat exchanger according to claim 29,
said internal volume having a maximum height (H) and a maximum width (W),
said internal volume having a H/W ratio greater than 1.
32. The heat exchanger according to claim 31,
said core being spaced from the top and bottom of said internal volume by at least 0.2 H.
33. The heat exchanger according to claim 31,
said fluid inlet being spaced from the top and bottom of said internal volume by at least 0.3 H.
34. The heat exchanger according to claim 31,
said core having a maximum height (h),
said core and shell having a h/H ratio of less than 0.75.
35. The heat exchanger according to claim 34, said h/H ratio being 0.25-0.5.
36. The heat exchanger according to claim 31,
said core having a minimum width (w),
said core and shell having a w/W ratio less than 0.95.
37. The heat exchanger according to claim 29,
said sidewall extending along a central sidewall axis
said core providing for counter-current heat exchange between two fluids flowing substantially parallel to the direction of extension of the central sidewall axis.
38. The heat exchanger according to claim 37, said core defining a plurality of core-side passageways and a plurality of shell-side passageways, said core-side and shell-side passageways being fluidly isolated from one another, said shell-side passageways presenting a normally-lower inlet and a normally-upper outlet, said shell-side passageways extending from the normally-lower inlet to the normally-upper outlet.

39. The heat exchanger according to claim 38, said core-side and shell-side passageways extending substantially parallel to the direction of extension of the sidewall axis.

40. The heat exchanger according to claim 29, said core being a brazed-aluminum, plate-fin core.

41. A heat exchanger comprising:

a shell defining an internal volume, said shell comprising a substantially cylindrical sidewall extending along a central sidewall axis and a normally-lower end cap coupled to a normally-lower end of said sidewall; and a core disposed in the shell, said core defining a plurality of core-side passageways and a plurality of shell-side passageways, said core-side passageways being fluidly isolated from the internal volume of the shell, said shell-side passageways presenting opposite open ends that provide fluid communication with the internal volume of the shell, said shell-side passageways extending in a direction that is substantially parallel to the direction of extension of the sidewall axis so that a thermosiphon effect can be created in the shell-side passageways when the heat exchanger is positioned with the sidewall axis in a substantially upright orientation, said shell including an inlet, a first outlet, and a second outlet, each communicating with the internal volume of the shell, said first and second outlets being spaced from one another along the sidewall axis, said first and second outlets being disposed on generally opposite ends of the shell, said second outlet being defined in said normally-lower end cap.

42. The heat exchanger according to claim 41, said plurality of shell-side passageways being open only at the ends so that any fluid entering the shell-side passageways must enter through one of the ends.

43. The heat exchanger according to claim 41, said core being a plate-fin core.

44. The heat exchanger according to claim 41, said core being a brazed-aluminum, plate-fin core.

45. The heat exchanger according to claim 41, said internal volume having a maximum height (H) measured along the sidewall axis and a maximum width (W) measured perpendicular to the sidewall axis, said internal volume having a H/W ratio greater than 1.

46. The heat exchanger according to claim 45, said shell including a normally-upper end cap, said maximum height (H) being measured between the normally-upper and the normally-lower end caps, said core presenting a normally-upper end that is spaced from the normally-upper end cap by a first maximum distance of at least 0.2 H, said core presenting a normally-lower end that is spaced from the normally-lower end cap by a second maximum distance of at least 0.2 H, said first and second maximum distances being measured substantially parallel to the direction of extension of the sidewall axis.

47. The heat exchanger according to claim 46, said first and second maximum distances being at least 2 feet.

48. The heat exchanger according to claim 45, said core having a maximum height (h) measured along the sidewall axis, said core and shell having a h/H ratio less than 0.75.

49. The heat exchanger according to claim 41, said inlet being formed in the sidewall.

50. A core-in-kettle heat exchanger system comprising:

a shell comprising a substantially cylindrical sidewall extending along a central sidewall axis and a normally-lower end cap coupled to a normally-lower end of said sidewall;

a plate-fin core disposed in the shell; and a support structure configured to support the shell in a vertical configuration where the sidewall axis is substantially upright, said shell including an inlet, a first outlet, and a second outlet, each communicating with the internal volume of the shell, said first and second outlets being spaced from one another along the sidewall axis, said first and second outlets being disposed on generally opposite ends of the shell, said second outlet being defined in said normally-lower end cap.

51. The system according to claim 50, said core being a brazed-aluminum, plate-fin core.

52. The system according to claim 50, said shell defining an internal volume within which the core is disposed, said internal volume having a maximum height (H) measured along the sidewall axis and a maximum width (W) measured perpendicular to the sidewall axis, said internal volume having a H/W ratio greater than 1.

53. The system according to claim 52, said shell including a normally-upper end cap, said maximum height (H) being measured between the normally-upper and the normally-lower end caps, said core presenting a normally-upper end that is spaced from the normally-upper end cap by a first maximum distance of at least 0.2 H, said core presenting a normally-lower end that is spaced from the normally-lower end cap by a second maximum distance of at least 0.2 H, said first and second maximum distances being measured substantially parallel to the direction of extension of the sidewall axis.

54. A system according to claim 53, said first and second maximum distances being at least 2 feet.

55. A system according to claim 52, said core having a maximum height (h) measured along the sidewall axis, said core and shell having a h/H ratio less than 0.75.

56. A system according to claim 50, said inlet being formed in the sidewall.

57. An apparatus comprising:

a cold box defining an internal volume; and a plurality of vertical core-in-kettle heat exchangers disposed in the internal volume, said cold box defining a purge gas inlet and a purge gas outlet, said cold box being substantially fluid-tight except for the purge gas inlet and outlet.

58. The apparatus according to claim 57; and a substantially loose insulation material disposed in the internal volume of the cold box and substantially surrounding the core-in-kettle heat exchangers.

59. The apparatus according to claim 58; and said insulation material comprising perlite.

60. The apparatus according to claim 57; and a hydrocarbon monitor operable to detect the presence of hydrocarbons, said hydrocarbon monitor being disposed in fluid communication with the purged gas outlet.

61. A liquefied natural gas facility for cooling a natural gas feed stream by indirect heat exchange with one or more refrigerants, said liquefied natural gas facility comprising:

a first refrigeration cycle for cooling the natural gas stream via indirect heat exchange with a first refrigerant, said first refrigeration cycle comprising a first vertical core-in-kettle heat exchanger, said first vertical core-in-kettle heat exchanger defining a kettle-side volume and a core-side volume fluidly isolated from one another, said kettle-side volume being configured to receive the first refrigerant, said core-side volume being configured to receive the natural gas stream, said kettle-side volume being defined within a shell comprising a normally-lower end cap, said shell including an inlet, a first outlet, and a second outlet, each communicating with the internal volume of the shell, said first and second outlets being spaced from one another along the sidewall axis, said first and second outlets being disposed on generally opposite ends of the shell, said second outlet being defined in said normally-lower end cap.

62. The facility according to claim 61, said first refrigerant comprising predominantly propane, propylene, ethane, ethylene, or carbon dioxide.

63. The facility according to claim 61, said first refrigerant comprising predominantly ethylene.

64. The facility according to claim 61, said first refrigeration cycle employing a plurality of vertical core-in-kettle heat exchangers to sequentially cool the natural gas stream via indirect heat exchange with the first refrigerant.

65. The facility according to claim 64, said first refrigeration cycle comprising a cold box receiving said plurality of vertical core-in-kettle heat exchangers.

66. The facility according to claim 61; and a second refrigeration cycle for cooling the natural gas stream via indirect heat exchange with a second refrigerant of different composition than the first refrigerant.

67. The facility according to claim 66, said second refrigerant comprising predominantly propane, propylene, ethane, ethylene, or carbon dioxide.

68. The facility according to claim 66, said first refrigerant comprising predominantly ethylene, said second refrigerant comprising predominantly propane.

69. The facility according to claim 68, said second refrigeration cycle being located upstream of the first refrigeration cycle.

70. The facility according to claim 66, said second refrigeration cycle comprising a second vertical core-in-kettle heat exchanger.

71. The facility according to claim 66, and an open methane refrigeration cycle disposed downstream of the first and second refrigeration cycles.

72. The heat exchanger according to claim 29, said liquid outlet being in fluid communication with a pressure reducer.

73. The heat exchanger according to claim 41, said second outlet being in fluid communication with a pressure reducer.

74. A system according to claim 50, said second outlet being in fluid communication with a pressure reducer.

75. The facility according to claim 61, said second outlet being in fluid communication with a pressure reducer.

76. The method according to claim 1, (g) maintaining the level of liquid phase refrigerant in the shell at an elevation where the core is partially submerged in the liquid phase refrigerant during said transferring of step (c).

77. The process according to claim 18, said kettle volume receiving said refrigerant and maintaining at least a portion of said refrigerant in said liquid phase, said core being partially submerged in said liquid phase of said refrigerant during said cooling.

* * * * *